US008584998B1

(12) United States Patent
Peterson

(10) Patent No.: US 8,584,998 B1
(45) Date of Patent: Nov. 19, 2013

(54) WINDOW AIR CONDITIONER UNIT MOUNTING SYSTEM

(76) Inventor: Andrew Peterson, Lawrence, NY (US)

( * ) Notice: Subject to any disclaimer, the term of this patent is extended or adjusted under 35 U.S.C. 154(b) by 169 days.

(21) Appl. No.: 13/200,680

(22) Filed: Sep. 28, 2011

(51) Int. Cl.
*A47F 5/00* (2006.01)

(52) U.S. Cl.
USPC ..... 248/208; 182/62; 454/204

(58) Field of Classification Search
USPC ..... 248/674, 208, 236, 209, 235, 241; 182/56, 57, 62; 454/204
See application file for complete search history.

(56) References Cited

U.S. PATENT DOCUMENTS

| | | | | | |
|---|---|---|---|---|---|
| 399,491 | A * | 3/1889 | Bukawietis | 182/62 |
| 1,531,159 | A * | 3/1925 | Timmons | 248/236 |
| 2,116,427 | A * | 5/1938 | Duncan | 182/60 |
| 2,628,052 | A * | 2/1953 | Cira | 248/236 |
| 2,717,139 | A * | 9/1955 | Jewell | 248/208 |
| 2,758,456 | A * | 8/1956 | Wheeler | 62/262 |
| 2,891,754 | A * | 6/1959 | Kuhlenschmidt et al. | 248/208 |
| 2,895,699 | A * | 7/1959 | Lidsky | 248/208 |
| 2,935,284 | A * | 5/1960 | Reeves | 248/208 |
| 3,164,353 | A * | 1/1965 | Rene | 248/237 |
| 3,273,843 | A * | 9/1966 | Bell, Jr. et al. | 248/208 |
| 3,394,910 | A * | 7/1968 | Ulich | 248/208 |
| 4,510,852 | A * | 4/1985 | Sorrentino | 454/204 |
| 5,636,816 | A * | 6/1997 | Burton et al. | 248/208 |
| 5,967,478 | A * | 10/1999 | Tynes | 248/241 |
| 6,767,278 | B1 | 7/2004 | Peterson | |
| 7,350,759 | B1 * | 4/2008 | Gray | 248/644 |
| 7,975,441 | B2 * | 7/2011 | McCarriston | 52/204.5 |
| 8,091,844 | B1 * | 1/2012 | Bragg | 248/208 |
| 8,167,260 | B2 * | 5/2012 | Boccia et al. | 248/236 |
| 2007/0023592 | A1 * | 2/2007 | Makoso | 248/200.1 |
| 2009/0071180 | A1 * | 3/2009 | Jones | 62/262 |
| 2012/0137499 | A1 * | 6/2012 | Agnihotri | 29/462 |

* cited by examiner

*Primary Examiner* — Bradley Duckworth
(74) *Attorney, Agent, or Firm* — Edward P Dutkiewicz

(57) ABSTRACT

A window air conditioning mounting system comprising a base subassembly having generally I-shaped configuration. There is also a shackle being coupled to the base subassembly. There is a strut having a generally T-shaped configuration coupled to the shackle and to the base subassembly. Lastly there is an upper cross member comprising a pair of generally C-shaped components. The components slidably receiving each other.

8 Claims, 4 Drawing Sheets

FIG. 1
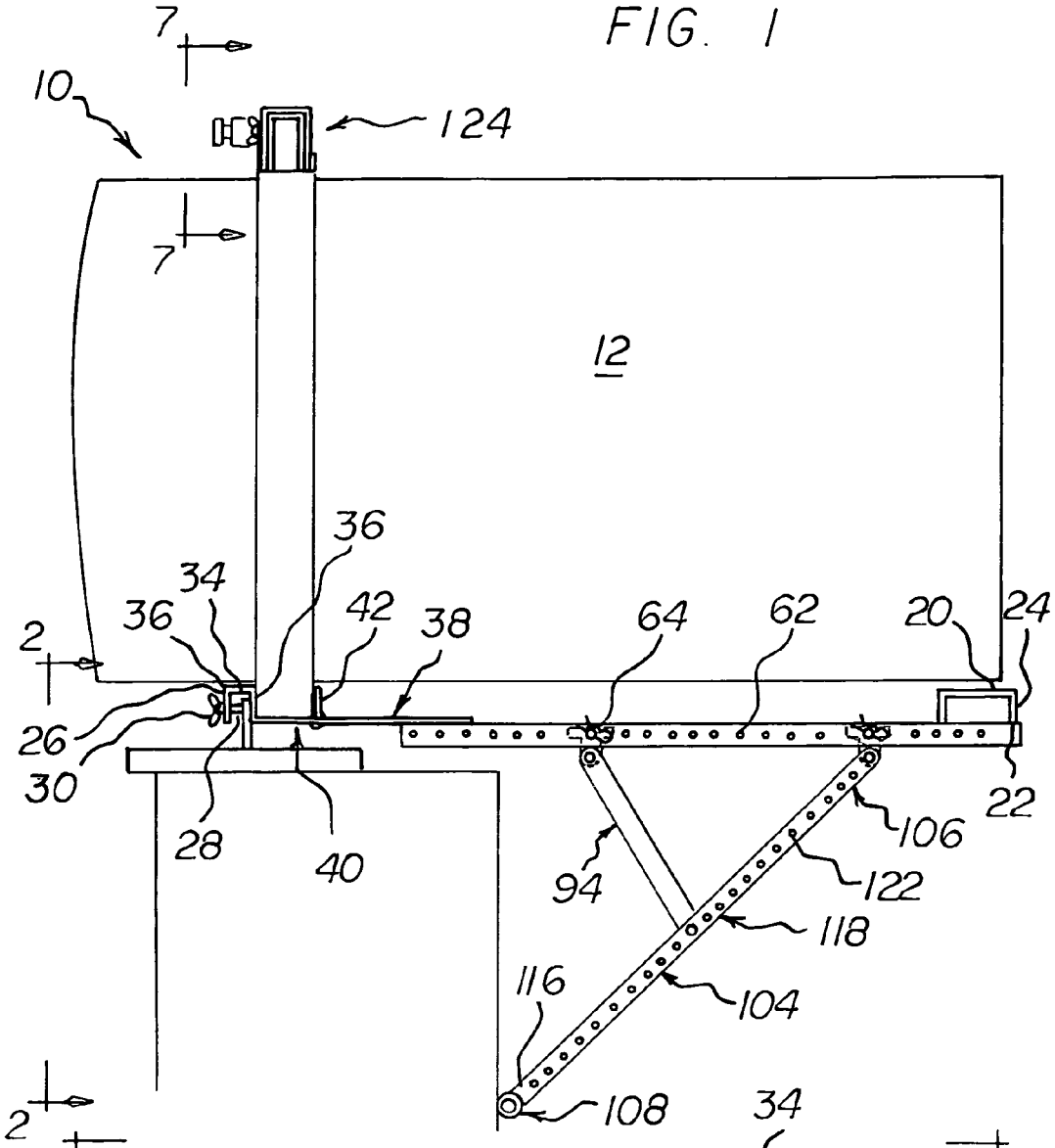
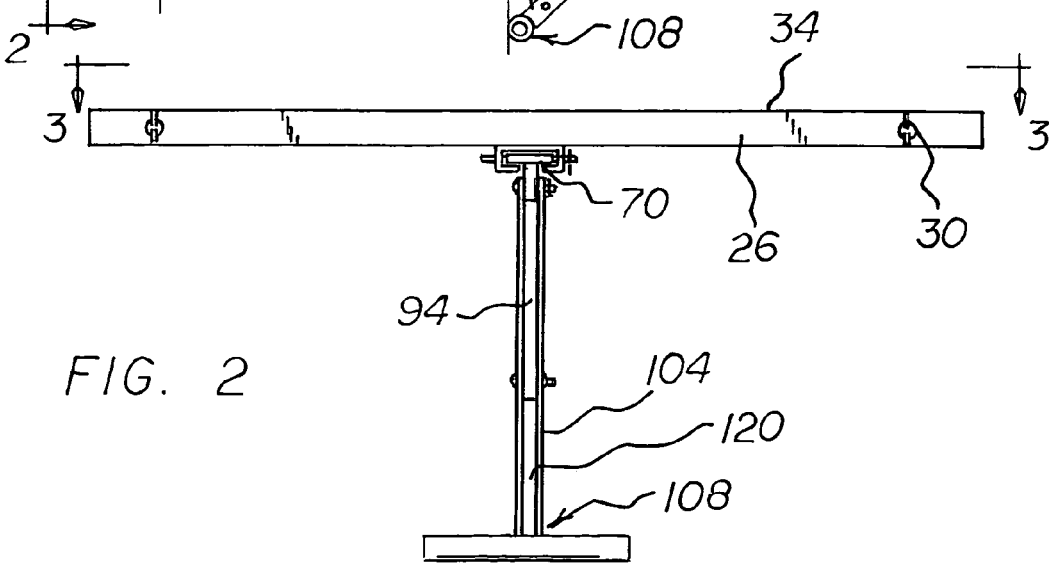
FIG. 2

FIG. 7
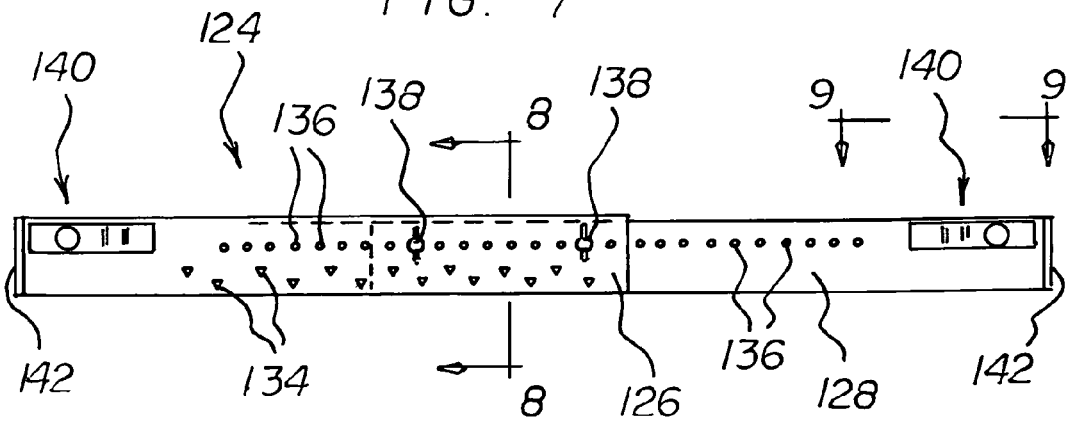
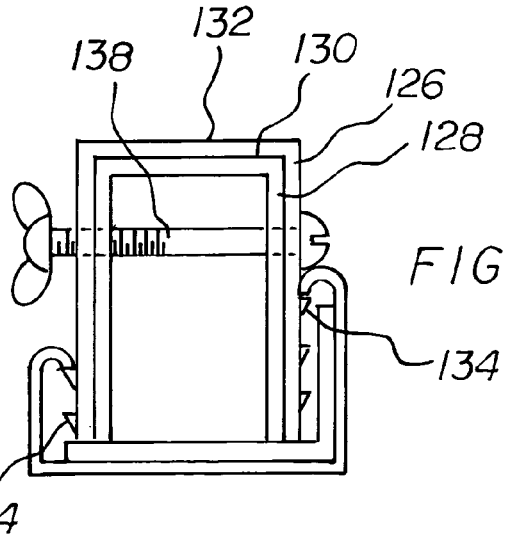
FIG. 8
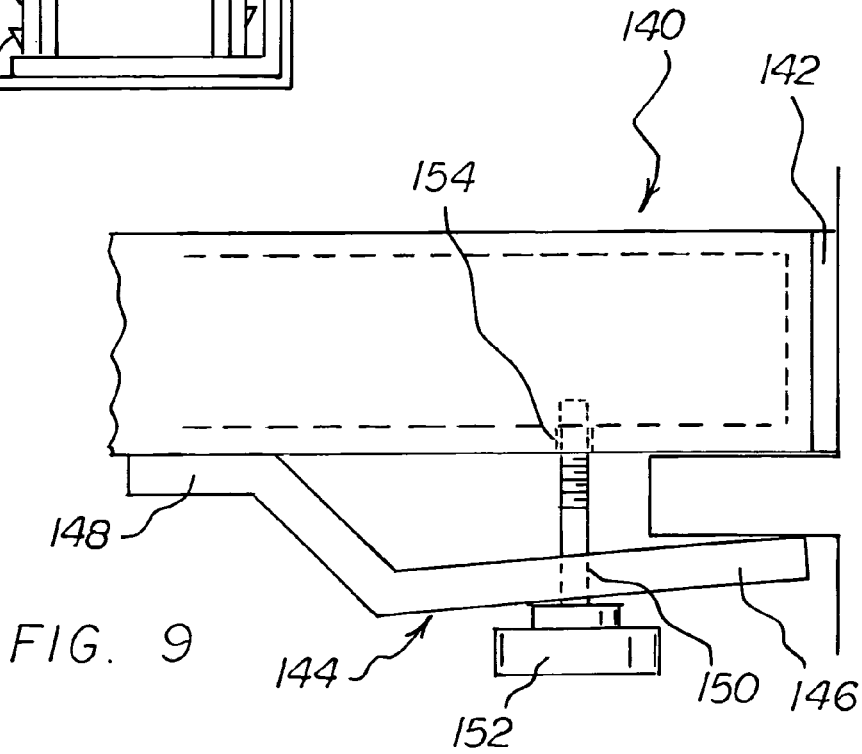
FIG. 9

WINDOW AIR CONDITIONER UNIT MOUNTING SYSTEM

RULE 1.78(F)(1) DISCLOSURE

The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a window air conditioner unit mounting system and more particularly pertains to an improved way to mount a window air conditioner unit.

2. Description of the Prior Art

The use of window mounts is known in the prior art. More specifically, window mounts previously devised and utilized for the purpose of affixing an air conditioning unit to a window opening are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the prior art does not describe window air conditioner unit mounting system that allows an improved way to mount a window air conditioner unit.

In this respect, the window air conditioner unit mounting system, according to the present invention, substantially departs from the conventional concepts and designs of the prior art, and in doing so provides an apparatus primarily developed for the purpose of providing an improved way to mount a window air conditioner unit to a window opening.

Therefore, it can be appreciated that there exists a continuing need for a new and improved window air conditioner unit mounting system which can be used for mounting a window air conditioner unit in a window opening. In this regard, the present invention substantially fulfills this need.

SUMMARY OF THE INVENTION

In view of the foregoing disadvantages inherent in the known types of window mounts now present in the prior art, the present invention provides an improved window air conditioner unit mounting system. As such, the general purpose of the present invention, which will be described subsequently in greater detail, is to provide a new and improved window air conditioner unit mounting system which has all the advantages of the prior art and none of the disadvantages.

To attain this, the present invention essentially comprises a window air conditioning unit mounting system. The mounting system comprises several components, in combination.

First, there is a base subassembly. The base subassembly is fabricated of a rigid material, such as metal or plastic. The subassembly has a generally I-shaped configuration. The base subassembly has an inner end cross member and an outer end cross member. The base assembly inner end cross member has a first length. The base subassembly outer end cross member has a second length. The first length is longer than the second length.

The inner end cross member has an inner portion and an outer portion. The inner portion has a generally C-shaped configuration with an upper surface and two parallel side surfaces, being an inner side and an outer side. The C-shaped configuration forms a recess therein. The inner side of the inner end cross member has a pair of threaded locking holes therein. The threaded locking holes of the inner end cross member each have an associated locking thumb screw.

The outer portion of the inner end cross member has a generally rectilinear configuration with an upper surface, a lower surface, and a peripheral edge there between. The outer portion of the inner end cross member is continuous with the inner portion of the inner end cross member.

The base subassembly has an intermediate member. The base subassembly intermediate member has a generally C-shaped configuration, having an upper surface, a lower surface, and a pair of parallel side surfaces. Each of the parallel side surfaces have a plurality of adjustment holes therein. The side surface adjustment holes have a pair of associated adjustment hole pins. Each of the adjustment hole pins have an associated retainer. The C-shaped intermediate member forms a downwardly disposed recess therein, the recess forming a slot in the lower surface of the intermediate member.

The base subassembly intermediate member has an exterior surface and an interior surface, the interior surface forming an intermediate member interior. The downwardly disposed recess of the intermediate member, at least partially, contains an inner slidably mounted down leg and an outer slidably mounted down leg within the interior of the intermediate member.

Each of the slidably mounted down legs have an upper portion having generally solid rectangular construction, having an upper surface, a lower surface, a pair of parallel side surfaces, and a pair of parallel end surfaces. The end surfaces of each of the upper portions of each of the slidably mounted down legs have an adjustment pin hole therethrough. The slidably mounted down leg adjustment pin holes are sized to receive the adjustment hole pin. Each of the down legs is slidably coupled to the intermediate member of the base subassembly.

Each of the slidably mounted down legs have an lower portion forming a generally downwardly disposed tab. Each of the tabs of the slidably mounted down legs has a strut adjustment pin hole there through, with each strut adjustment pin hole having an associated strut adjustment pin.

There is a shackle. The shackle is fabricated of a rigid material and has a generally C-shaped configuration, with a proximal end and a distal end, with a length there between. The proximal end of the shackle is sized to contain the tab of the inner slidably mounted down leg. The proximal end of the shackle has a shackle pivot pin hole which is sized to receive the strut adjustment pin, thereby rotatably coupling the inner slidably mounted down leg and the shackle.

The distal end of the shackle has a strut adjustment pin hole therethrough.

The outer end cross member of the base subassembly has a generally C-shaped configuration with an upper portion and two parallel side portions and a pair of parallel lower portions. The upper portion has a generally rectilinear configuration. The two parallel side portions each have a generally rectilinear configuration. The two parallel lower portions each have a generally rectilinear configuration.

The intermediate member and the outer end cross member are removably attached, such as by a bolt.

There is a strut. The strut has a generally T-shaped configuration with a proximal portion and a distal portion. The proximal portion has a generally C-shaped configuration, with an outer surface, two parallel side surfaces, an attachment end and a free end, with an intermediate length therebetween. The C-shaped configuration of the proximal portion of the strut forms an inwardly disposed recess.

Each of the side surfaces of the proximal portion of the strut have a plurality of holes there through. The holes of the side surfaces of the proximal portion are sized to receive the strut adjustment pin.

The attachment end of the proximal portion of the strut is rotatably coupled to the tab of the outer slidably mounted down leg. One of the strut adjustment pins completes the rotatably attachment of the proximal portion of the strut to the outer slidably mounted down leg.

The intermediate length of the strut is rotatably coupled to the distal end of the shackle. One of the strut adjustment pins completes the rotatably attachment of the intermediate length of the strut to the shackle.

The distal portion of the strut is oriented generally perpendicular to the free end of the proximal portion of the strut. The distal portion of the strut has a generally hollow tubular configuration, and is fixedly attached to the free end of the proximal portion of the strut.

Lastly, there is an upper cross member. The upper cross member is fabricated of a rigid material, such as metal or plastic. The upper cross member comprises a pair of generally C-shaped components, being a larger component having a larger component interior and a smaller component having a smaller component interior. The larger component is sized to slidably receive the smaller component within the interior of the larger component.

The larger component has an inner surface and an outer surface. The outer surface of the larger component has at least one protrusion. In the preferred embodiment, there are a plurality of protrusions. The larger component and the smaller component, of the upper cross member, each have a plurality of locking holes there through. The locking holes are located so as to allow at least two of the locking holes through the larger component and the smaller component to be aligned. The upper cross member has a pair of locking through-bolts associated with the locking holes of the larger component and the smaller component.

The larger component and the smaller component each have a proximal end (not shown) and a distal end. The distal end of the larger component and the distal end of the smaller component each have a distal end cap. The cap is preferably made of a non-marring material.

The larger component of the upper cross member and the smaller component of the upper cross member each have a distal end mounting clip, with each distal end mounting clip having a generally Z-shaped configuration. Each of the Z-shaped clips has an outer portion and an inner portion, with the outer portion of each Z-shaped clip having a bolt aperture therethrough. The distal end of both the larger component of the upper cross member and the smaller component of the upper cross member each have a threaded bolt hole therein.

Each of the threaded apertures of the component bolt holes has an associated locking screw.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved window air conditioner unit mounting system which has all of the advantages of the prior art window mounts and none of the disadvantages.

It is another object of the present invention to provide a new and improved window air conditioner unit mounting system which may be easily and efficiently manufactured and marketed.

It is further object of the present invention to provide a new and improved window air conditioner unit mounting system which is of durable and reliable constructions.

An even further object of the present invention is to provide a new and improved window air conditioner unit mounting system which is susceptible of a low cost of manufacture with regard to both materials and labor, and which accordingly is then susceptible of low prices of sale to the consuming public, thereby making such window air conditioner unit mounting system economically available to the buying public.

Even still another object of the present invention is to provide a window air conditioner unit mounting system for an improved way to mount a window air conditioner unit to a window opening.

Lastly, it is an object of the present invention to provide a new and improved window air conditioning unit mounting system, comprising several components, in combination, having a base subassembly in a generally I-shaped configuration. The base subassembly being coupled to a lower surface of an existing window air conditioning unit. There is also provided a slidable, upper cross member comprising a pair of generally C-shaped components. The upper cross member is operatively coupled to an upper surface of the air conditioning unit.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of the system attached to an air conditioning window unit. Note the support bearing the weight of the unit.

FIG. 2 is a view taken along line 2-2 of FIG. 1.

FIG. 7 is a frontal elevational view of the upper cross member.

FIG. 8 is a view taken along line 8-8 of FIG. 7.

FIG. 9 is a view taken along line 9-9 of FIG. 7.

The same reference numerals refer to the same parts throughout the various Figures.

DESCRIPTION OF THE PREFERRED EMBODIMENT

Figure 3:
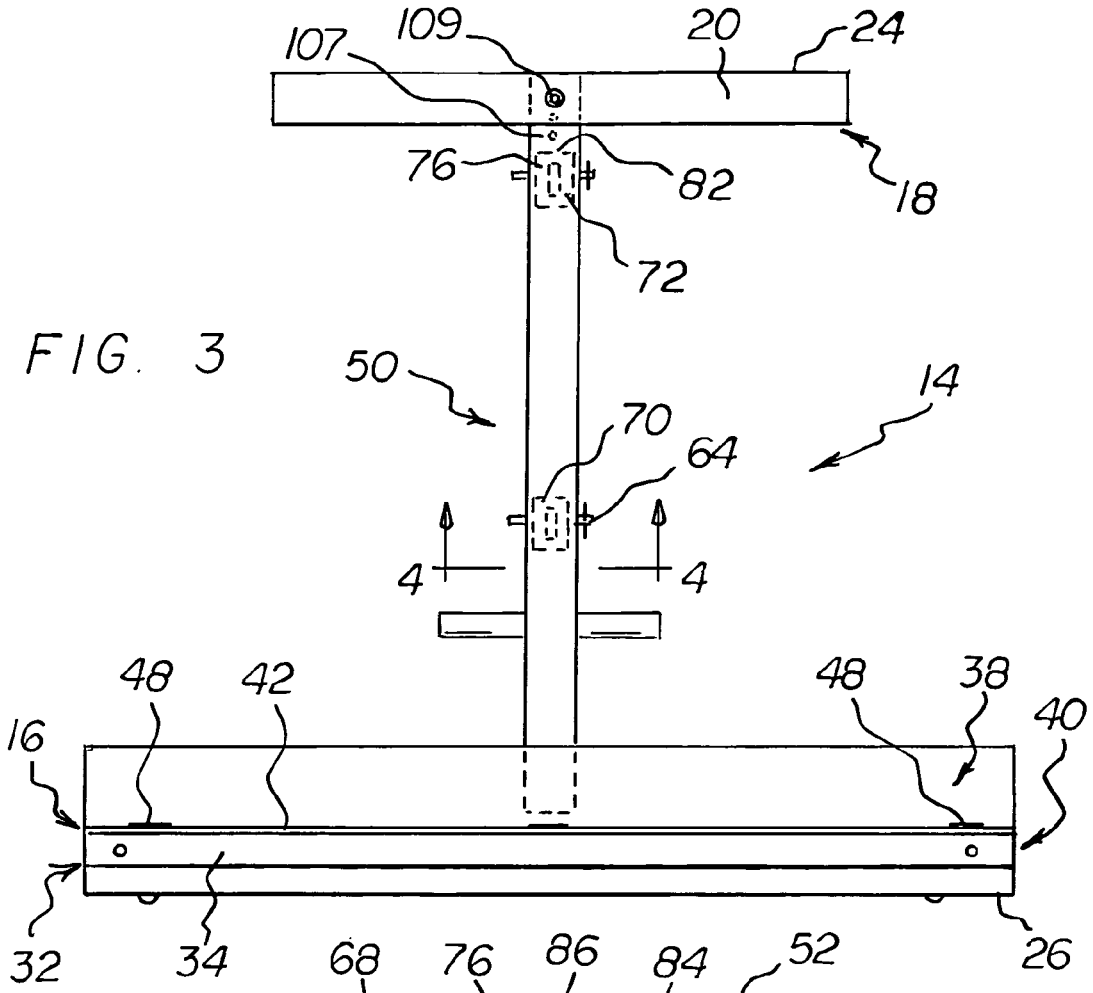
FIG. 3 is a view taken along line 3-3 of FIG. 2.
Figure 4:
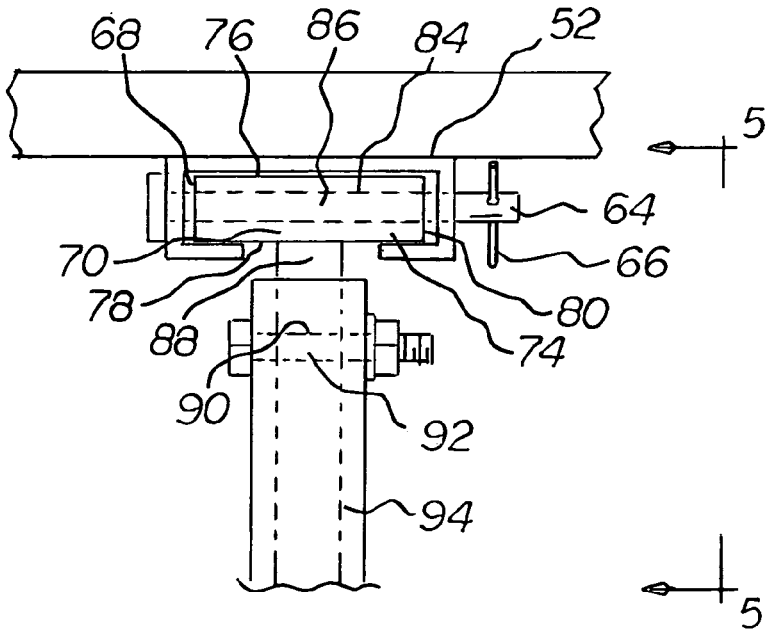
FIG. 4 is a view taken along line 4-4 of FIG. 3.
Figure 5:
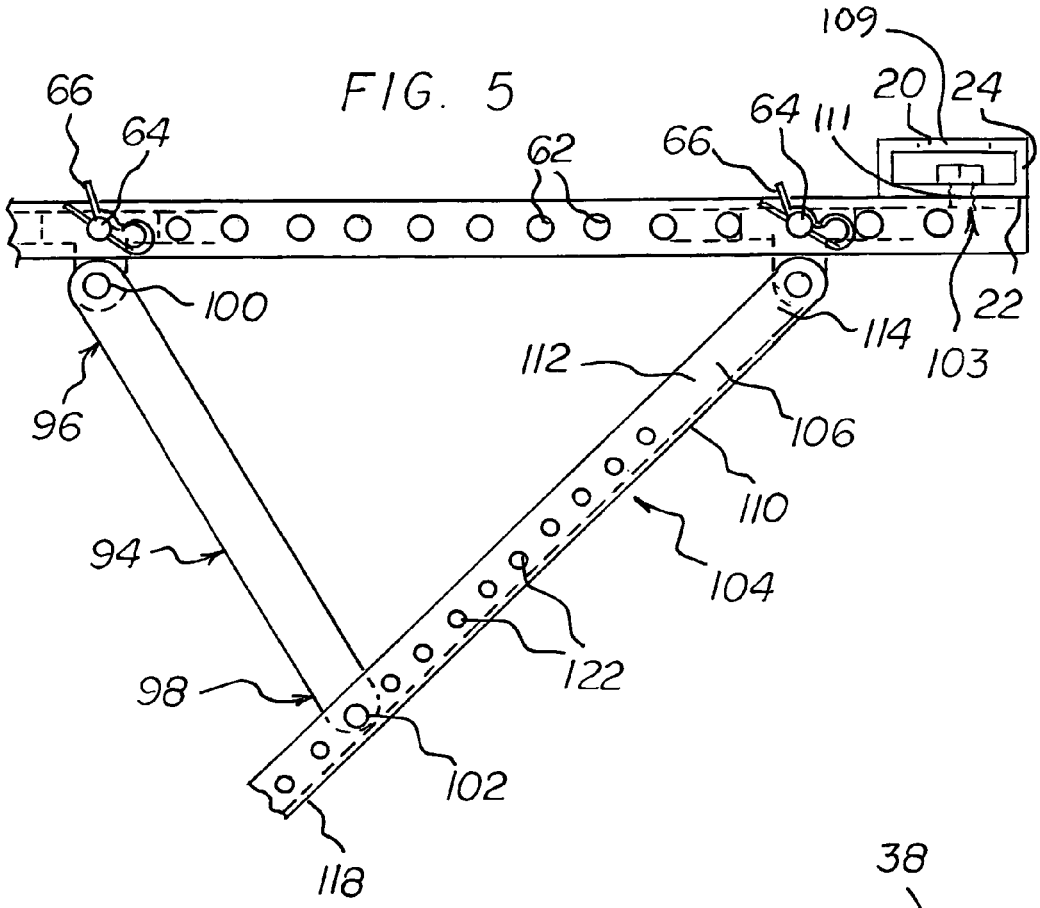
FIG. 5 is a view taken along line 5-5 of FIG. 4.
Figure 6:
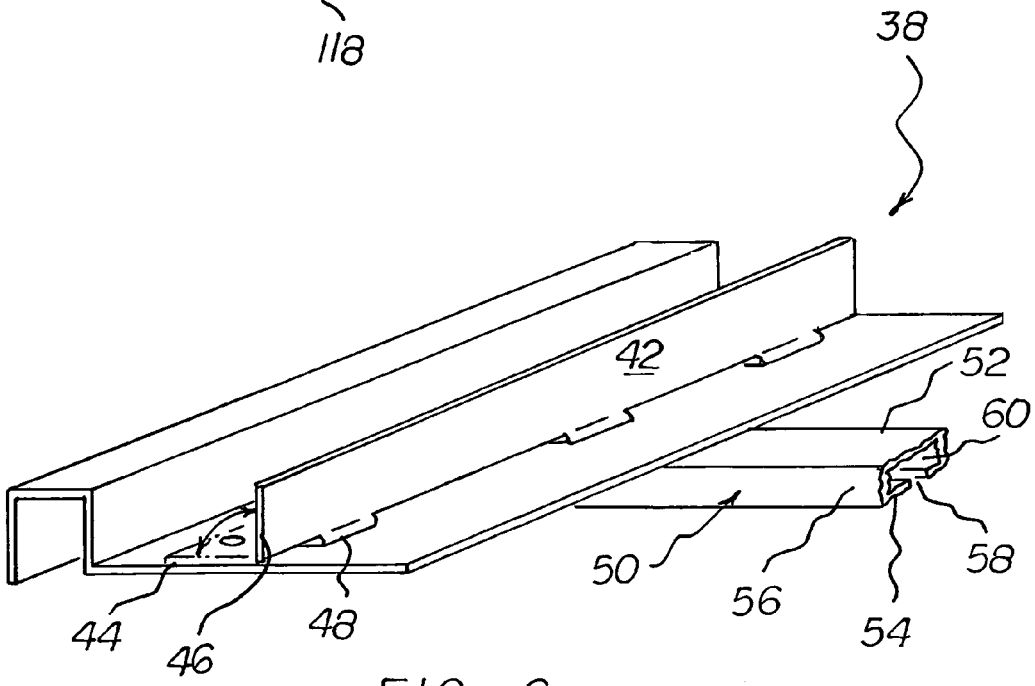
FIG. 6 is a close-up view of the inner end, showing the intermediate portion with the rotatable sheet.

With reference now to the drawings, and in particular to FIG. 1 thereof, the preferred embodiment of the new and improved window air conditioner unit mounting system embodying the principles and concepts of the present invention and generally designated by the reference numeral 10 will be described.

The present invention, the window air conditioner unit mounting system 10 is comprised of a plurality of components. Such components in their broadest context include a base subassembly, and an upper cross member. Such components are individually configured and correlated with respect to each other so as to attain the desired objective.

The present invention, a window air conditioning unit mounting system 10 is comprised of a plurality of components, such components in their broadest context include a base subassembly, and an upper cross member. Such components are individually configured and correlated with respect to each other so as to attain the desired objective. The system is shown with an existing air conditioning unit 12. The mounting system comprises several components, in combination.

First, there is a base subassembly 14. The base subassembly is fabricated of a rigid material, such as metal or plastic. The subassembly has a generally I-shaped configuration. The base subassembly has an inner end cross member 16 and an outer end cross member 18. The base assembly inner end cross member has a first length. The base subassembly outer end cross member has a second length. The first length is longer than the second length.

The outer end cross member has a generally rectilinear configuration with an upper surface 20, a lower surface 22, and a peripheral edge 24 there between.

The inner end cross member has an inner portion and an outer portion. The inner end cross member has a generally C-shaped configuration with a downwardly disposed innermost lip 26 and a downwardly disposed innermost recess 28. The innermost lip has a locking screw 30.

The inner portion 32 has an upper surface 34 and two parallel side surfaces 36, being an inner side and an outer side. The C-shaped configuration forms the recess therein. The inner side of the inner end cross member has a pair of threaded locking holes therein. The threaded locking holes of the inner end cross member each have the associated locking thumb screw 30.

The inner end cross member of the base subassembly has an outermost portion 38, and an intermediate portion 40 which has a rotatable sheet 42 which can be positioned horizontally 44 or vertically 46, by rotating about the point of attachment 48 which couples the sheet to the intermediate portion. This rotatable sheet allows the use of the invention with various configurations of window air conditioning units. The innermost lip of the inner end cross member, the intermediate portion of the inner end cross member and the outermost portion of the inner end cross member are continuous.

The base subassembly has an intermediate member 50. The base subassembly intermediate member has a generally C-shaped configuration, having an upper surface 52, a lower surface 54, and a pair of parallel side surfaces 56. The base subassembly intermediate member lower surface forms a slot 58. The base subassembly intermediate member also has an interior 60.

Each of the parallel side surfaces have a plurality of adjustment holes 62 therein. The side surface adjustment holes have a pair of associated adjustment hole pins 64. Each of the adjustment hole pins have an associated retainer 66. The C-shaped intermediate member forms the downwardly disposed recess therein, the recess formed the slot in the lower surface of the intermediate member and the interior of the intermediate member of the base subassembly.

The base subassembly intermediate member has an exterior surface and an interior surface, the interior surface forming an intermediate member interior 68. The downwardly disposed recess of the intermediate member, at least partially, contains an inner slidably mounted down leg 70 and an outer slidably mounted down leg 72 within the interior of the intermediate member.

Each of the slidably mounted down legs have an upper portion 74 having generally solid rectangular construction, having an upper surface 76, a lower surface 78, a pair of parallel side surfaces 80, and a pair of parallel end surfaces 82. The end surfaces of each of the upper portions of each of the slidably mounted down legs have an adjustment pin hole 84 therethrough. The slidably mounted down leg adjustment pin holes are sized to receive the adjustment hole pin 86. Each of the down legs is slidably coupled to the intermediate member of the base subassembly.

Each of the slidably mounted down legs have an lower portion forming a generally downwardly disposed tab 88. Each of the tabs of the slidably mounted down legs has a strut adjustment pin hole 90 there through, with each strut adjustment pin hole having an associated strut adjustment pin 92.

There is a shackle 94. The shackle is fabricated of a rigid material and has a generally C-shaped configuration, with a proximal end 96 and a distal end 98, with a length there between. The proximal end of the shackle is sized to contain the tab of the inner slidably mounted down leg. The proximal end of the shackle has a shackle pivot pin hole 100 which is sized to receive the strut adjustment pin, thereby rotatably coupling the inner slidably mounted down leg and the shackle.

The distal end of the shackle has a strut adjustment pin hole 102 therethrough.

The outer end cross member 18 of the base subassembly has a generally rectangular shaped configuration with an upper surface 20 and two parallel side surfaces 24 and a lower surface 22. The upper portion has a generally rectilinear configuration. The two parallel side portions each have a generally rectilinear configuration. The lower portion has a generally rectilinear configuration.

The intermediate member has at least one threaded bolt hole located near the end of the length of the intermediate member, with an associated intermediate end bolt. There is at least one matching bolt hole 109 located centrally along the length of the outer end cross member, allowing passage of the bolt through the upper surface, so that the lower surface bolt hole 111 receives and allows passage of the attaching bolt. This configuration allows the upper surface of the cross member to be generally smooth, with no bolt head protruding. This allows for the intermediate member and the out end cross member to be removably attached, such as by a bolt, screw, clamp, wire, or clip. There is an associated bolt for each bolt hole in the intermediate member.

In variations of this embodiment, there are a plurality of threaded bolt holes in the intermediate member, located near the end of the length of the intermediate member. This allows the adjustment of the distance between the inner cross member and the outer cross member, while allowing the removable attachment of the outer cross member to the intermediate member.

The removable attachment of the intermediate member and outer end cross member is to allow the optional use of the end cross member, should the existing air conditioning window unit require such use. If the window air conditioning unit has built in side shades, for fitting the unit to the window opening, the out end cross member may be eliminated.

There is a strut 104. The strut has a generally T-shaped configuration with a proximal portion 106 and a distal portion 108. The proximal portion has a generally C-shaped configuration, with an outer surface 110, two parallel side surfaces 112, an attachment end 114 and a free end 116, with an intermediate length 118 therebetween. The C-shaped configuration of the proximal portion of the strut forms an inwardly disposed recess 120.

Each of the side surfaces of the proximal portion of the strut have a plurality of holes 122 there through. The holes of the side surfaces of the proximal portion are sized to receive the strut adjustment pin.

The attachment end of the proximal portion of the strut is rotatably coupled to the tab of the outer slidably mounted down leg. One of the strut adjustment pins completes the rotatably attachment of the proximal portion of the strut to the outer slidably mounted down leg.

The intermediate length of the strut is rotatably coupled to the distal end of the shackle. One of the strut adjustment pins completes the rotatably attachment of the intermediate length of the strut to the shackle.

The distal portion of the strut is oriented generally perpendicular to the free end of the proximal portion of the strut. The distal portion of the strut has a generally hollow tubular configuration, and is fixedly attached to the free end of the proximal portion of the strut.

Lastly, there is an upper cross member 124. The upper cross member is fabricated of a rigid material, such as metal or plastic. The upper cross member comprises a pair of generally C-shaped components, being a larger component 126 having a larger component interior and a smaller component 128 having a smaller component interior. The larger component is sized to slidably receive the smaller component within the interior of the larger component.

The larger component has an inner surface 130 and an outer surface 132. The outer surface of the larger component has at least one protrusion 134. In the preferred embodiment there are a plurality of like-configured protrusions.

The larger component and the smaller component, of the upper cross member, each have a plurality of locking holes 136 there through. The locking holes are located so as to allow at least two of the locking holes through the larger component and the smaller component to be aligned. The upper cross member has a pair of locking through-bolts 138 associated with the locking holes of the larger component and the smaller component.

The larger component and the smaller component each have a proximal end (not shown) and a distal end 140. The distal end of the larger component and the distal end of the smaller component each have a distal end cap 142. The cap is preferably made of a non-marring material. The end cap may be in the form of a ring, such as an o-ring.

The larger component of the upper cross member and the smaller component of the upper cross member each have a distal end mounting clip 144, with each distal end mounting clip having a generally Z-shaped configuration. Each of the Z-shaped clips has an outer portion 146 and an inner portion 148, with the outer portion of each Z-shaped clip having an aperture 150 therethrough. The inner portion of each of the Z-shaped clips being attached to either the distal end of the larger component or the distal end of the smaller component.

Each of the apertures of the Z-shaped clips has an associated locking screw 152.

The distal ends of both the larger component and the smaller component each have a threaded bolt hole therein 154. The threaded bolt hole of the distal ends of the larger component and the smaller component is sized to mate with and threadedly receive the locking screw 152.

In application the air conditioning unit, hereinafter the "unit", is installed securely. The unit is supported from beneath, or firmly fastened from inside the window with angled metal, such as aluminum or steel. One may also use metal brackets, mounting rails, or metal or plastic strapping.

The supporting brackets are then structurally fastened to the building, i.e., the window frame, which must be strong enough for the size and weight of the AC unit.

Objects, or shims, are then used to adjust the position of the AC unit. The objects, or shims, must have an independent source of fastening or attachment so as to comply with a number of rigid building codes.

The secured leveling objects prevent movement and shifting due to vibrations from the AC unit, by wind or other weather conditions.

The unit is installed so that the unit remains in place when the window is opened. The window should be affixed so that the window cannot be opened accidentally.

The unit is then tilted slightly downwardly on the outermost end so as to provide water drainage. This tilting is accomplished by using the adjustability of the shackle and strut. The tilt need only be a degree or two, so as to prevent overtilting, and destabilization of the installation.

The advantage of the mounting system as herein described is that the described application conforms with rigid building codes, such as the New York State Building Code. The installation also provides structural security, and is simple to do.

The upper cross member comprises two C-channels. One channel fits inside the other and is position to provide the desired overall length. Each sliding channel has a line of holes placed in a particular order so when two bars are connected at least two holes will coincide and could be secured in place with the locking bolts. Each channel ends with an end mounting clip. The end mounting clip goes over the window frame, and the upper cross member is secured in place with a locking screw. The vertical distal end of each channel has a rubber pad that is cut to size so as to fit inside the window frame. A non-marring material is used to make the pad.

The larger component of the upper cross member has a series of punch holes, which form protuberances, placed on the different levels. The dispersion of the protuberances acts to provide extra security to keep the bar inside the universal L-shape extrusion located on the top of an AC unit, that is used for expandable window shades.

The base subassembly comprises an inner end cross member, an intermediate member, and an outer end cross member. A rotatable sheet enables the matching of the lower surface of any number of AC units to this invention. The air conditioning unit is then coupled to the base subassembly.

The rotating sheet is shaped so it accommodates AC units that have a channel for window shades attached to the unit's bottom, and for AC units having built-in opening for window shades.

The base subassembly is fasten to the window frame with the two thumb screws of the inner cross member of the base subassembly, thereby providing the required structural fastening to the building, in conformance with building codes.

Using the adjustable strut and shackle, the location of the support may be adjusted, which provides the required support from beneath the a/c unit, as required by rigid building codes.

The I-shaped configuration of the base subassembly adds additional support so as to keep the AC unit in place during installation, while the window is open.

This invention is an improvement on the existing prior art in that this system provides a bottom support for the window air conditioning unit, or "unit". When mounted, the unit is primarily outside of the window frame, and hence, the weight is biased to the outside of the window frame. The present system also provides an easy, safe, way to mount the unit within the window frame. The installation is simple, requiring minimal, if any, tools for the installation. In many cases the turning of the thumb screws is all that is necessary to install the unit. The system also provides a mount which conforms with rigid building codes. The system also allows for the opening and closing of the window in the presence of the mounted unit.

The advantages include universal application, allowing the system to be used with windows which have a bottom frame as a vertically placed bar that is raised above the inside window sill. The base subassembly is attached, over the window frame lip, and secured in place with the locking screws.

In the case of windows that have a bottom frame of the outside window frame being on the same level as the inside of the window sill, the base subassembly is mounted to the sill with the two thumb screws.

The system may be used with a wide variety of sizes of units, making application practically universal.

Application of the system may be in the presence or absence of an exterior, or outside, window sill. The movable shackle and strut allow for a wide range of configurations to accommodate a vast majority of window configurations. In all configurations, the shackle, strut, and intermediate member form a triangle, which provides great strength to the system configuration.

The configurations available with this system supports the weight of the unit from beneath. Both the base subassembly, and the upper cross member, are fastened to the structure of the window, and support the unit, preventing movement due to structural vibration or wind vibration.

The I-shaped configuration of the base subassembly provides support during installation during installation, which also provides support when the window is opened, with the upper cross member maintaining the unit position within the window opening.

Adjustments to position may be made using the shackle and strut adjustments, which may be made independently.

Lastly, the unit orientation may be set so that there is a slight outward tilt, allowing moisture to run away from the window, draining from the outside extent of the air conditioning unit.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A window air conditioning unit mounting system comprising, in combination:

a base subassembly having generally I-shaped configuration;

a shackle being coupled to the base subassembly;

a strut having a generally T-shaped configuration with a proximal portion and a distal portion, the strut being coupled to the shackle and to the base subassembly;

an upper cross member comprising a pair of generally C-shaped components, being a larger component having a larger component interior and a smaller component having a smaller component interior, the larger component being sized to slidably receive the smaller component within the interior of the larger component, the larger component having an inner surface and an outer surface, the outer surface of the larger component having at least one protrusion, the upper cross member being coupled to an upper surface of an existing window air conditioning unit;

the base subassembly having an inner end cross member and an outer end cross member, the base assembly inner end cross member having a first length with the base subassembly outer end cross member having a second length;

the shackle having a generally C-shaped configuration, with a proximal end and a distal end, with a length there between;

the proximal portion of the strut having a generally C-shaped configuration with an outer surface and two parallel side surfaces and an attachment end and a free end, with an intermediate length therebetween;

the base subassembly inner end cross member having an inner portion and an outer portion, the inner portion having a generally C-shaped configuration with an upper surface and two parallel side surfaces, being an inner side and an outer side, the C-shaped configuration forming a recess therein, the outer portion of the inner end cross member having a generally rectilinear configuration with an upper surface and a lower surface and a peripheral edge there between, the base subassembly having an intermediate member having a generally C-shaped configuration with an upper surface and a lower surface and a pair of parallel side surfaces, each of the parallel side surfaces having a plurality of adjustment holes therein;

the C-shaped configuration of the proximal portion of the strut forming an inwardly disposed recess, with each of the side surfaces of the proximal portion of the strut having a plurality of holes there through, the holes of the side surfaces of the proximal portion being sized to receive a strut adjustment pin; and the larger component and the smaller component of the upper cross member each having a plurality of locking holes there through, the locking holes being located so as to allow at least two of the locking holes through the larger component and the smaller component to be aligned.

2. The window air conditioning unit mounting system as described in claim 1, with the system further comprising:

the inner side of the inner end cross member of the base subassembly having a pair of threaded locking holes therein, the threaded locking holes of the inner end cross member each having an associated locking thumb screw, the outer portion of the inner end cross member being continuous with the inner portion of the inner end cross member;

the intermediate member side surface adjustment holes having a pair of associated adjustment hole pins, with each of the adjustment hole pins have an associated retainer;

the proximal end of the shackle being sized to contain the tab of the inner slidably mounted down leg, the proximal end of the shackle having a shackle pivot pin hole which is sized to receive the strut adjustment pin, thereby rotatably coupling an inner slidably mounted down leg and the shackle; and the attachment end of the proximal portion of the strut being rotatably coupled to the tab of the outer slidably mounted down leg, with one of the strut adjustment pins completing the rotatably attachment of the proximal portion of the strut to an outer slidably mounted down leg.

3. The window air conditioning unit mounting system as described in claim 2, with the system further comprising:

the C-shaped intermediate member forming a downwardly disposed recess therein, with the recess forming a slot in the lower surface of the intermediate member, the base subassembly intermediate member having an exterior surface and an interior surface, the interior surface forming an intermediate member interior, the downwardly disposed recess of the intermediate member at least partially containing the inner slidably mounted down leg and the outer slidably mounted down leg within the interior of the intermediate member;

the intermediate length of the strut being rotatably coupled to the distal end of the shackle, with one of the strut adjustment pins completing the rotatably attachment of the intermediate length of the strut to the shackle; and the upper cross member having a pair of locking through-bolts associated with the locking holes of the larger component and the smaller component, the larger component and the smaller component each having a distal end, the distal end of the larger component and the distal end of the smaller component each have a distal end cap.

4. The window air conditioning unit mounting system as described in claim 3, with the system further comprising:

each of the slidably mounted down legs having an upper portion having generally solid rectangular construction, with the upper portion having an upper surface and a lower surface and a pair of parallel side surfaces and a pair of parallel end surfaces, the end surfaces of each of the upper portions of each of the slidably mounted down legs having an adjustment pin hole therethrough;

the distal portion of the strut being oriented generally perpendicular to the free end of the proximal portion of the strut; and the larger component of the upper cross member and the smaller component of the upper cross member each having a distal end mounting clip.

5. The window air conditioning unit mounting system as described in claim 4, with the system further comprising:

the slidably mounted down leg adjustment pin holes being sized receive the adjustment hole pin, with each of the down legs being slidably coupled to the intermediate member of the base subassembly, with each of the slidably mounted down legs having an lower portion forming a generally downwardly disposed tab, each of the tabs of the slidably mounted down legs having a strut adjustment pin hole there through;

the distal end of the shackle having a strut adjustment pin hole therethrough;

the distal portion of the strut having a generally hollow tubular configuration and being fixedly attached to the free end of the proximal portion of the strut; and each upper cross member distal end mounting clip having a generally Z-shaped configuration, each of the Z-shaped clips having an outer portion and an inner portion, with the inner portion of each Z-shaped clip having a threaded aperture therethrough.

6. The window air conditioning unit mounting system as described in claim 5, with the system further comprising:

each strut adjustment pin hole having an associated strut adjustment pin, the outer end cross member of the base subassembly having a generally C-shaped configuration with an upper portion and two parallel side portions and a pair of parallel lower portions, the upper portion having a generally rectilinear configuration; and each of the threaded apertures of the upper cross member Z-shaped clips having an associated locking screw.

7. The window air conditioning unit mounting system as described in claim 6, with the system further comprising the two parallel side portions of the outer end cross member of the base subassembly each having a generally rectilinear configuration, the two parallel lower portions each having a generally rectilinear configuration, with a gap between the two parallel lower portions, the intermediate member and the outer end cross member being fixedly attached.

8. The window air conditioning unit mounting system as described in claim 7, with the system further comprising:

the base subassembly being fabricated of a rigid material with the base subassembly first length being longer than the base subassembly second length;

the shackle being fabricated of a rigid material;

the upper cross member being fabricated of a rigid material; and the upper cross member distal cap being made of a non-marring material.

* * * * *